US006099367A

United States Patent [19]

White et al.

[11] Patent Number: 6,099,367

[45] Date of Patent: Aug. 8, 2000

[54] HYDROSTATIC PROPULSION SYSTEM FOR A MARINE VESSEL

[75] Inventors: Brian R. White; Vince E. Notareschi; Grant W. Hines, all of Stillwater, Okla.

[73] Assignee: Brunswick Corporation, Lake Forest, Ill.

[21] Appl. No.: 09/260,346

[22] Filed: Mar. 2, 1999

[51] Int. Cl.[7] ..... B63H 21/165

[52] U.S. Cl. ..... 440/5

[58] Field of Search ..... 440/5, 1, 3, 6; 60/418, 427, 429, 436, 443, 447, 449, 456, 459, 463, 464, 489

[56] References Cited

U.S. PATENT DOCUMENTS

| | | | |
|---|---|---|---|
| 3,660,975 | 5/1972 | Martin et al. | 60/19 |
| 3,672,166 | 6/1972 | Isaac | 60/53 |
| 3,685,286 | 8/1972 | Lee | 60/53 |
| 4,215,546 | 8/1980 | Hager et al. | 60/456 |
| 4,273,543 | 6/1981 | McCusker | 440/4 |
| 4,358,280 | 11/1982 | Jeanson et al. | 440/61 |
| 4,412,500 | 11/1983 | Krautkremer | 114/151 |
| 4,871,332 | 10/1989 | Rodriquez | 440/5 |
| 4,901,529 | 2/1990 | Iino et al. | 60/489 |
| 5,061,212 | 10/1991 | Morgenthaler et al. | 440/50 |
| 5,094,077 | 3/1992 | Okada | 60/436 |
| 5,121,603 | 6/1992 | Widemann | 60/447 |
| 5,168,703 | 12/1992 | Tobias | 60/418 |
| 5,398,505 | 3/1995 | Oogushi et al. | 60/426 |
| 5,476,400 | 12/1995 | Theophanides | 440/5 |
| 5,588,294 | 12/1996 | Sakakura et al. | 60/464 |
| 5,813,887 | 9/1998 | Mark | 440/5 |

FOREIGN PATENT DOCUMENTS

| | | | |
|---|---|---|---|
| 56-53995 | 5/1981 | Japan | 440/5 |

*Primary Examiner*—S. Joseph Morano
*Assistant Examiner*—Ajay Vasudeva
*Attorney, Agent, or Firm*—William D. Lanyi

[57] ABSTRACT

A hydrostatic marine propulsion system is provided with a valve that is able to bypass an infinitely variable amount of hydraulic fluid from a hydrostatic pump to bypass a hydrostatic motor which is used to drive a propeller shaft. The infinitely variable valve is connected between the hydrostatic pump and the hydrostatic motor with dual outlets which cause fluid to flow either to the hydrostatic motor or to a reservoir to be recycled through the hydrostatic pump. An engine control unit changes the amount of hydraulic fluid passing through the hydrostatic motor as a function of the operating condition of an engine which drives the hydrostatic pump. In this way, engine speed can be controlled during various modes of operation.

20 Claims, 8 Drawing Sheets

HYDROSTATIC PROPULSION SYSTEM FOR A MARINE VESSEL

BACKGROUND OF THE INVENTION

1. Field of the Invention

The present invention is generally related to a hydrostatic propulsion system for a marine vessel and, more particularly, to a hydrostatic propulsion system that uses an infinitely variable valve to distribute pressurized fluid from a hydrostatic pump to a hydrostatic motor as a function of a selected parameter, such as engine speed or throttle position or both.

2. Description of the Prior Art

Many different types of marine propulsion systems are well known to those skilled in the art. Some propulsion systems use gasoline powered internal combustion engines while others use diesel engines. It is known that a marine propulsion system can incorporate a hydrostatic pump, driven by an engine, in combination with a hydrostatic motor attached in torque transmitting relation with a propeller shaft of a marine vessel.

U.S. Pat. No. 5,813, 887, which issued to Mark on Sep. 29, 1998, discloses a marine propulsion system. Referring to prior stern drive marine propulsion systems in which power is transmitted through an arrangement of clutches, bevel gears, and shafts to a propeller located between the water surface, the Mark patent discusses the disadvantages of the prior art systems, particularly when these systems are used in large commercial boats. The invention disclosed in the Mark patent provides an outdrive designed to surpass the horsepower and torque limitations set by prior art systems. In order to meet these objectives, the outdrive is designed to incorporate a multi-strand roller chain drive, replacing the conventional bevel gear arrangement. Using a chain drive in this application serves to increase durability of the drive while keeping the outer casing streamlined. The system uses a variable displacement pump driven by an engine. The pump is connected in fluid communication with a hydraulic motor that provides the torque to drive a propeller shaft.

U.S. Pat. No. 5,121,603 which issued to Widemann on Jun. 16, 1992, describes a device for pressure regulated variable displacement motors with RPM-dependent set pressure compensation. The hydrostatic system includes a variable displacement hydraulic motor whose absorption volume is adjusted by a pressure regulator, depending on the RPM's generated by the power source driving the system. The apparatus enables the variable displacement motor to fully utilize the drive power available from the power source over a range of operating speeds.

U.S. Pat. No. 3,660,975, which issued to Martin et al on May 9, 1972, discloses a hydrostatic transmission system in which there is provided an automated pump displacement control, a manual override device for overriding the displacement control to keep the pump displacement at a low level, and a device sensitive to pump inlet pressure to render the override device inoperative when the pump inlet pressure exceeds a predetermined value.

U.S. Pat. No. 3,685,286, which issued to Lee on Aug. 22, 1972, describes a fluid control valve. The valve has a pair of spool closure members which are slidable in unison to control flow between associated pairs of ports in response to relative movement between a pair of control elements on the valve. The relative movement causes axial displacement of actuators which engage an abutment secured to the spools, the abutment being biased into contact with the actuators.

U.S. Pat. No. 3,672,166, which issued to Isaac on Jun. 27, 1972, discloses a variable ratio hydrostatic transmission which comprises a hydraulic motor as well as a pump of which the cubic capacity is regulated by a mechanism that is sensitive to the pressure of liquid. This liquid is supplied by a pressure regulator on the movable member of which act, in the sense tending to increase the pressure, a force increasing with the speed of the pump and, in reverse sense, a force increasing with the resistant couple applied to the motor and a force proportional to the pressure. The transmission is used in automobiles.

U.S. Pat. No. 5,094,077, which issued to Okada on Mar. 10, 1992, discloses a hydrostatic transmission with interconnected swash plate neutral valve and brake unit. The transmission system axle driving apparatus is used for changing the speed of a vehicle which includes a hydraulic pump, hydraulic motor, and braking unit. Neutral valves at an open position are automatically returned to a closed position with the operation of a brake controller. This allows the vehicle to be started at slow speed but not abruptly.

U.S. Pat. No. 4,215,546, which issued to Hager et al on Aug. 5, 1980, describes a hydrostatic transmission control system which includes a variable displacement pump driving a constant displacement motor arranged in a hydraulic circuit having a controlled by-pass valve interconnected for position the pump swash plate in two established positions corresponding respectively to a stand still position or a full speed position of the motor. A thermal sensitive element is coupled to the valve control spool for bypassing the flow of the pump in the event of motor jamming.

U.S. Pat. No. 5,588,294, which issued to Sakakura et al on Dec. 31, 1996, describes a hydrostatic transmission that is constructed so that a check valve and a relief valve are made as compact as possible to supply oil to a closed circuit for connecting a hydraulic pump and a hydraulic motor, and to regulate maximum pressure in the closed circuit. A check valve and a relief valve are contained in a valve casing. A valve body of the relief valve is disposed opposite to a valve body of the check valve. A relief spring of the relief valve is retained by a cover detachable mounted to an open end of the valve casing, thereby facilitating pressure setting of the relief valve. The valve body of the relief valve is contained in a relief valve casing slidably disposed in the valve casing. A plunger, capable of urging the check valve in the opening direction via the relief valve casing, is provided in the cover, thereby enabling the check valve to be manually opened.

U.S. Pat. No. 5,168,703, which issued to Tobias on Dec. 8, 1992, describes a continuously active pressure accumulator power transfer system for a vehicle. It comprises an engine, a pump driven by the engine, a main pressure accumulator maintained at a substantially constant fluid pressure and a fluid volume by the pump during operation, a fluid motor for propelling the vehicle which is supplied with driving fluid pressure from the pressure accumulator and auxiliary units for operating the vehicle. The auxiliary units are also operated by fluid pressure from the pressure accumulator. The fluid motor and the auxiliary units are operated directly by fluid pressure from the accumulator without any direct connection with the engine.

The patents described above are hereby incorporated by reference in this description.

Although many different types of hydraulic propulsion systems are known to those skilled in the art, they are not generally used in marine applications in conjunction with pleasure craft or small commercial craft. Certain working vessels use hydraulic propulsion systems. However, hydraulic propulsion systems exhibit certain disadvantages which have inhibited their use in conjunction with pleasure craft or small commercial craft. For example, by their nature, hydrostatic propulsion systems typically have significantly lower operating efficiencies than conventional mechanical systems. Since hydrostatic propulsion systems use an engine as a prime mover, a hydrostatic pump driven by the engine, and a hydrostatic motor to drive a propeller shaft, the total system suffers from the combined inefficiencies of the hydrostatic pump and hydrostatic motor in addition to the other inefficiencies common to systems of this type. As a result, hydrostatic propulsion systems generally lack the acceleration capabilities that are particularly desirable in marine pleasure craft or small commercial craft. Therefore, although hydrostatic propulsion systems exhibit certain highly advantageous characteristics, they are not generally used in pleasure craft or small commercial craft because of the adverse effect of decreased efficiency on the operating characteristic of the propulsion system and the marine pleasure craft or small commercial craft with which it is used.

It would therefore by highly beneficial if a hydrostatic propulsion system could be configured in such a way that a marine pleasure craft or small commercial craft could take advantage of certain inherent beneficial characteristics of hydrostatic propulsion systems while avoiding certain inherent disadvantages such as reduced acceleration.

SUMMARY OF THE INVENTION

A preferred embodiment of the present invention comprises a first hydrostatic pump, a first engine having an output shaft connected to a driveshaft of the first hydrostatic pump, and a first sensor having an output which is representative of a preselected first parameter of the first engine. In a particular preferred embodiment of the present invention, the sensor provides an output which is representative of the operating speed of the engine, such as the revolutions per minute of its crankshaft. The preferred embodiment of the present invention further comprises a first hydrostatic motor and a first propeller attached to the shaft of the first hydrostatic motor. A fluid reservoir is connected in fluid communication with an inlet of the first hydrostatic pump to supply fluid to the pump. An outlet of the first hydrostatic motor is connected in fluid communication with the reservoir.

A valve is provided which has an inlet connected in fluid communication with the first hydrostatic pump, with the valve having first and second outlets. The valve is connected in fluid communication between the first hydrostatic pump and the first hydrostatic motor with the first outlet of the valve connected to an inlet of the first hydrostatic motor and with the second outlet of the valve connected in fluid communication with the fluid reservoir. In addition, a controller is provided which has an input connected in signal communication with an output of the sensor. The controller has an output connected in signal communication with an input of the first valve so that it can control the magnitude of the fluid flowing through the first and second outlets of the valve as a function of the preselected first parameter.

The first parameter can be engine speed which can be measured by a tachometer. The controller can regulate the first valve as a function of the speed of operation of the engine. A second sensor can also be connected with the engine to have an output which is representative of a preselected second parameter of the engine, such as throttle position. The valve can be controlled, by the controller, as a function of either engine speed, throttle position, or any other parameter based on the application of the system.

The marine propulsion system of the present invention can comprise both first and second hydrostatic motors and first and second propellers attached to shafts of the hydrostatic motors. In addition, it can comprise a fluid distributor which is connected in fluid communication between the first and second hydrostatic pumps and the first and second hydrostatic motors to distribute pressurized fluid to the two hydrostatic motors. It should be understood that the present invention allows a single engine to drive a single hydrostatic pump in combination with a single hydrostatic motor and propeller. However, the flexibility of the present invention can also allow a single engine to drive a single hydrostatic pump which, in turn, provides pressurized fluid to two hydrostatic motors attached to individual propeller shafts. Conversely, two engines can be used to drive two associated hydrostatic pumps which are connected in such a way that they provide pressurized fluid to a single hydrostatic motor with a propeller shaft. With each hydrostatic pump being driven by a prime mover, such as an internal combustion engine, the hydrostatic propulsion system of the present invention can incorporate one hydrostatic pump and one hydrostatic motor, one hydrostatic pump and two hydrostatic motors, two hydrostatic pumps and one hydrostatic motor, or two hydrostatic pumps and two hydrostatic motors. When necessary, a distributor can be used so that the total available quantity of pressurized fluid can be appropriately shared by two hydrostatic motors which each drive an individual propeller shaft.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
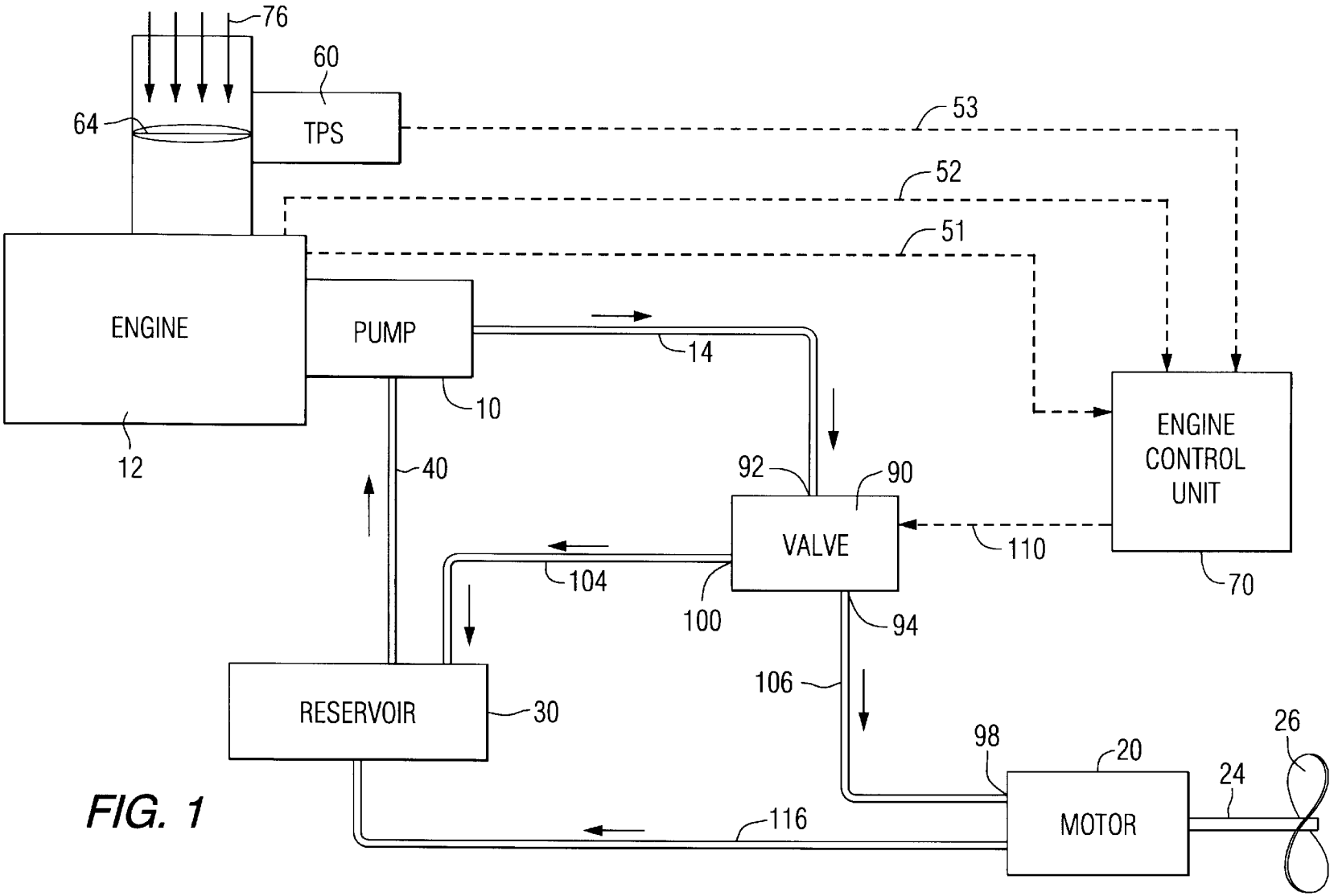
FIG. 1 is a simplified schematic of the present invention.

Throughout the description of the preferred embodiment, like components will be identified by like reference numerals.

FIG. 1 shows a highly simplified schematic representative of a hydrostatic marine propulsion system made in accordance with the concept of the present invention. A first hydrostatic pump 10 is driven by a first engine 12. Although not shown in FIG. 1, it should be understood that an output shaft of the first engine 12 is connected to a shaft of the first hydrostatic pump 10 to drive it and pressurize fluid which then flows through line 14.

A first hydrostatic motor 20 drives a first propeller shaft 24 to which a propeller 26 is attached for rotation. A fluid reservoir 30 provides a source of fluid that is drawn into the first hydrostatic pump 10, through line 40.

Various sensors can be used to monitor parameters of the first engine 12. For example, the temperature of an operating fluid can be measured, as represented by dashed line 51. The operating speed of the first engine 12 can be measured by an appropriate sensor such as a tachometer, and a representative signal can be provided on dashed line 52. Another sensor, such as a throttle position sensor 60, can provide information on dashed line 53 which is representative of the position of a throttle 64. Although not shown in the embodiment of FIG. 1, it should be understood that dashed line 51 can alternatively be connected between the reservoir 30 and an engine control unit 70 to monitor the temperature of the fluid in the reservoir 30.

In operation, air 76 is drawn into the first engine 12. Operation of the first engine 12 causes the first hydrostatic pump to rotate and pressurize fluid which flows through line 14 to a first valve 90. The first valve has a single inlet 92 connected in fluid communication with the first hydrostatic pump 10, through line 14. The valve 90 has a first outlet 94 that is connected to an inlet 98 of the first hydrostatic motor 20. A second outlet 100 of the first valve 90 is connected in fluid communication with the fluid reservoir 30, through line 104. The position of the valve 90 determines the ratio between the quantity of fluid flowing through line 106 to the first hydrostatic motor 20 and the quantity of fluid flowing through line 104 back to the reservoir. If the valve 90 is fully opened, under the control of the engine control unit 70 through signals on dashed lines 110, all of the fluid flowing through line 14 is directed through line 104 to the reservoir and the first hydrostatic motor 20 is completely bypassed. On the other hand, if the first valve 90 is completely closed under the control of the engine control unit 70, no fluid flows through line 104 to the reservoir 30 and all of the fluid flowing through line 14 is directed through line 106 to drive the first hydrostatic motor 20.

Fluid flowing through line 106 to drive the first hydrostatic motor 20 then returns to the reservoir 30 through line 116. The first hydrostatic pump 10 draws fluid from the reservoir 30, pressurizes it, and directs it through line 14 back to the valve 90 to be distributed according to the valve position determined by the engine control unit 70.

The simplified schematic system shown in FIG. 1 illustrates a single engine 12, a single hydrostatic pump 10, a single valve 90, and a single hydrostatic motor 20. However, as will be described below, the present invention has the flexibility to incorporate a plurality of engines, hydrostatic pumps, and hydrostatic motors.

Figure 2:
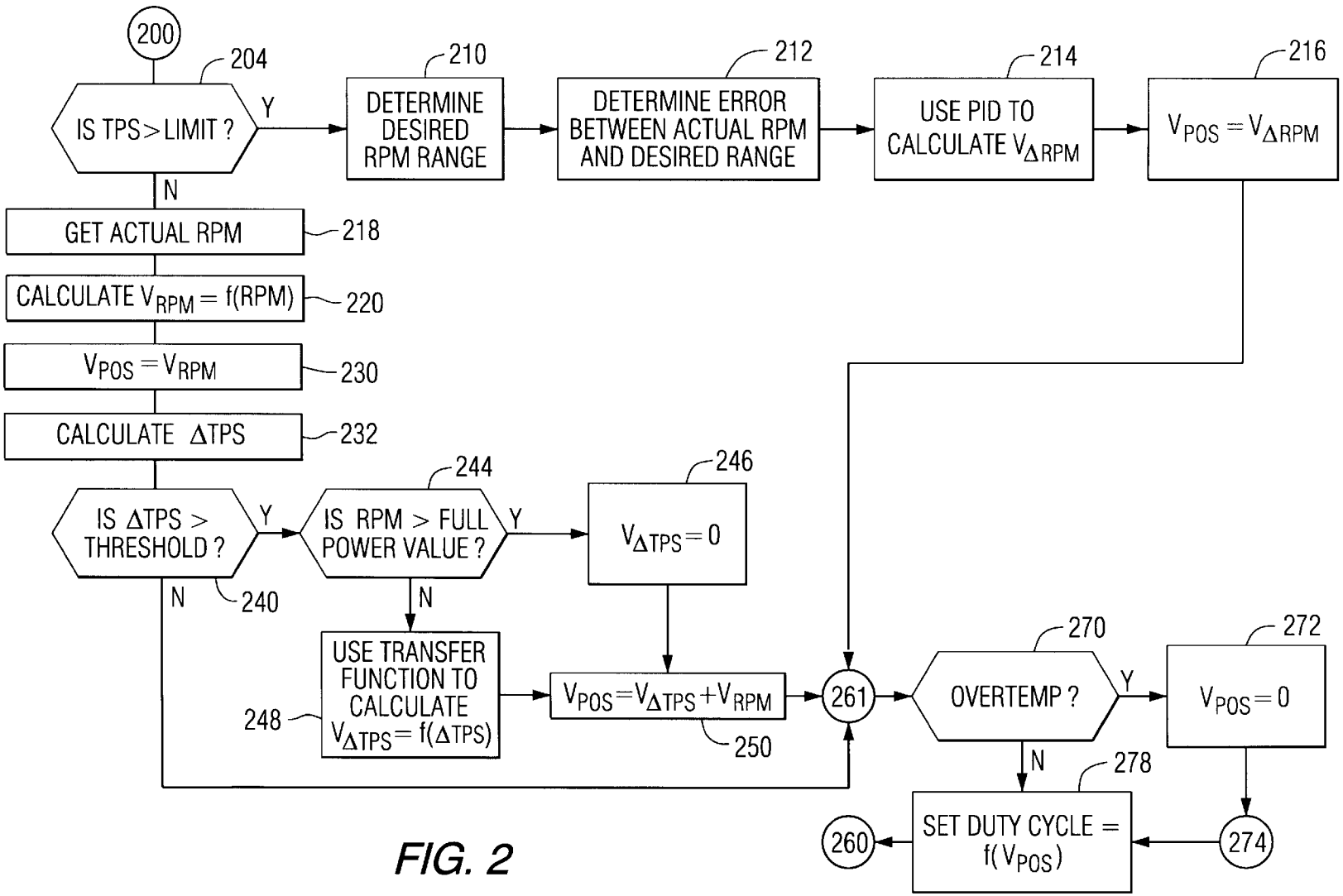
FIG. 2 is a flow chart describing the control algorithm by which an engine control unit controls the status of an infinitely variable valve.
Figure 3:
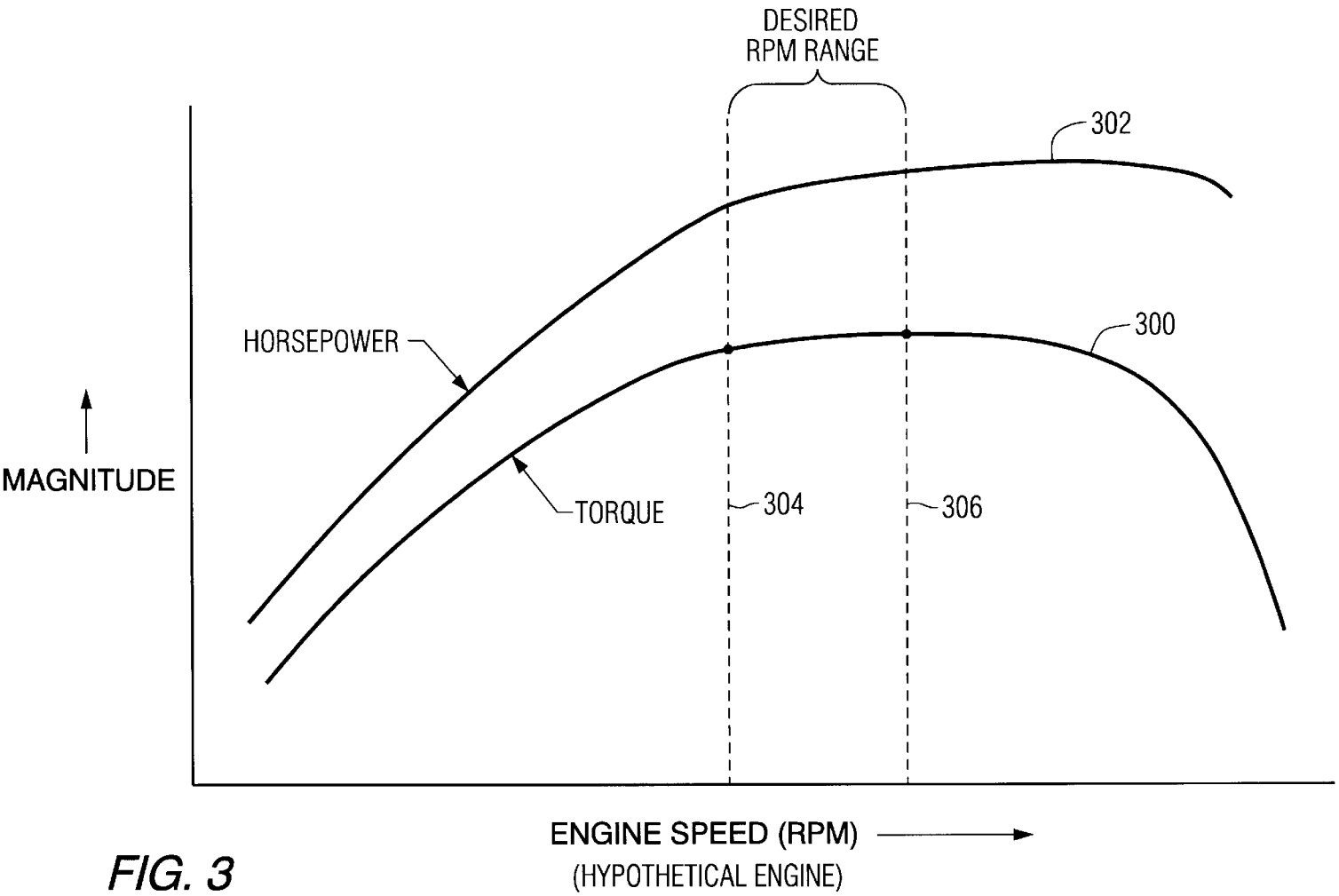
FIG. 3 shows the torque and horsepower characteristics as a function of engine speed for a hypothetical engine.

Control of the valve 90 by the engine control unit 70 can be performed in various different manners. One preferred control scheme is illustrated in a highly simplified schematic flow chart in FIG. 2. It should be understood that the flow chart in FIG. 2 is intended to provide a general description of the control variables and the type of actions taken by the engine control unit 70 in response to changes in magnitude of those control variables. The logical flow of the flow chart in FIG. 2 begins at node 200 after which the engine control unit 70 determines if a sudden movement of the throttle 64 has occurred at functional block 204. If the change in throttle position, as detected by the throttle position sensors 60 in FIG. 1, indicate that the operator of the marine vessel has changed the throttle handle position by a significant amount, the engine control unit 70 takes the steps shown in FIG. 2 beginning with functional block 210. It should be understood that the interrogation represented by functional block 204 is intended to determine if the throttle handle has been moved a significant amount, rather than merely a slight change. For example, if the operator of the marine vessel suddenly changes the control handle by moving the throttle from a near idle position to a position representing wide open throttle, or WOT, the throttle position would exceed the limit and the steps beginning with functional block 210 would be executed. The engine control unit 70 would first determine a desired engine speed range that has been preselected as a function of the propulsion system and the marine vessel on which it is used. As an example, FIG. 3 shows a hypothetical torque curve 300 and horsepower curve 302 for an exemplary marine propulsion system. As can be seen, both the torque curve 300 and the horsepower curve 302 vary as a function of engine speed. Functional block 210 in FIG. 2 would select an upper and lower engine speed limit, such as those represented by lines 304 and 306 in FIG. 3, and control the valve 90 in order to maintain the engine speed between those limits. The engine control unit 70 is intended to prevent changes in engine speed that would move the engine speed, measured in RPM's, out of the range defined by dashed lines 304 and 306. With reference to FIGS. 1, 2, and 3, if the engine speed is below the lower limit 304, the engine control unit 70 would command valve 90 to divert more fluid through line 104 to the reservoir 30 rather than through line 106 to the hydrostatic motor 20. This will allow the engine 12 to increase in speed to the range defined between dashed lines 304 and 306 in FIG. 3. If, on the other hand, the engine speed increases beyond the upper limit 306, the engine control unit 70 can increase the amount of fluid flowing through line 106 to the hydrostatic motor 20 and decrease the amount of fluid flowing through line 104 to the reservoir 30. This action will load the engine and decrease engine speed.

With reference to FIG. 2, the engine control unit 70 in FIG. 1 determines the error between the actual RPM and the desired RPM range as represented by functional block 212 in FIG. 2. A PID (proportional, integral, derivative) controller is used to calculate a desired valve position $V\Delta_{RPM}$ based on the difference between actual RPM and the desired range shown in FIG. 3. $V\Delta_{RPM}$ represents the valve position calculated only as a function of the RPM error which is calculated in functional block 212 with respect to the error between the actual RPM and the desired RPM range illustrated in FIG. 3 between the lower RPM limit 304 and upper RPM limit 306. This value is calculated by the PID control system of functional block 214. It is also used as the resultant valve position $V_{POS}$ as represented in functional block 216. It should be understood that the desired valve position $V_{POS}$ can be determined as a function of the RPM error (i.e. $V\Delta_{RPM}$), as described above, or as a function of other variables which will be described below.

If the interrogation in functional block 204 is negative because the operator has not requested a large change in the throttle position, the engine control unit 70 then calculates a desired valve position $V_{RPM}$ as a sole function of the engine RPM. This is represented in functional block 220 of FIG. 2 and in the graphical representation of FIG. 4.

Figure 4:
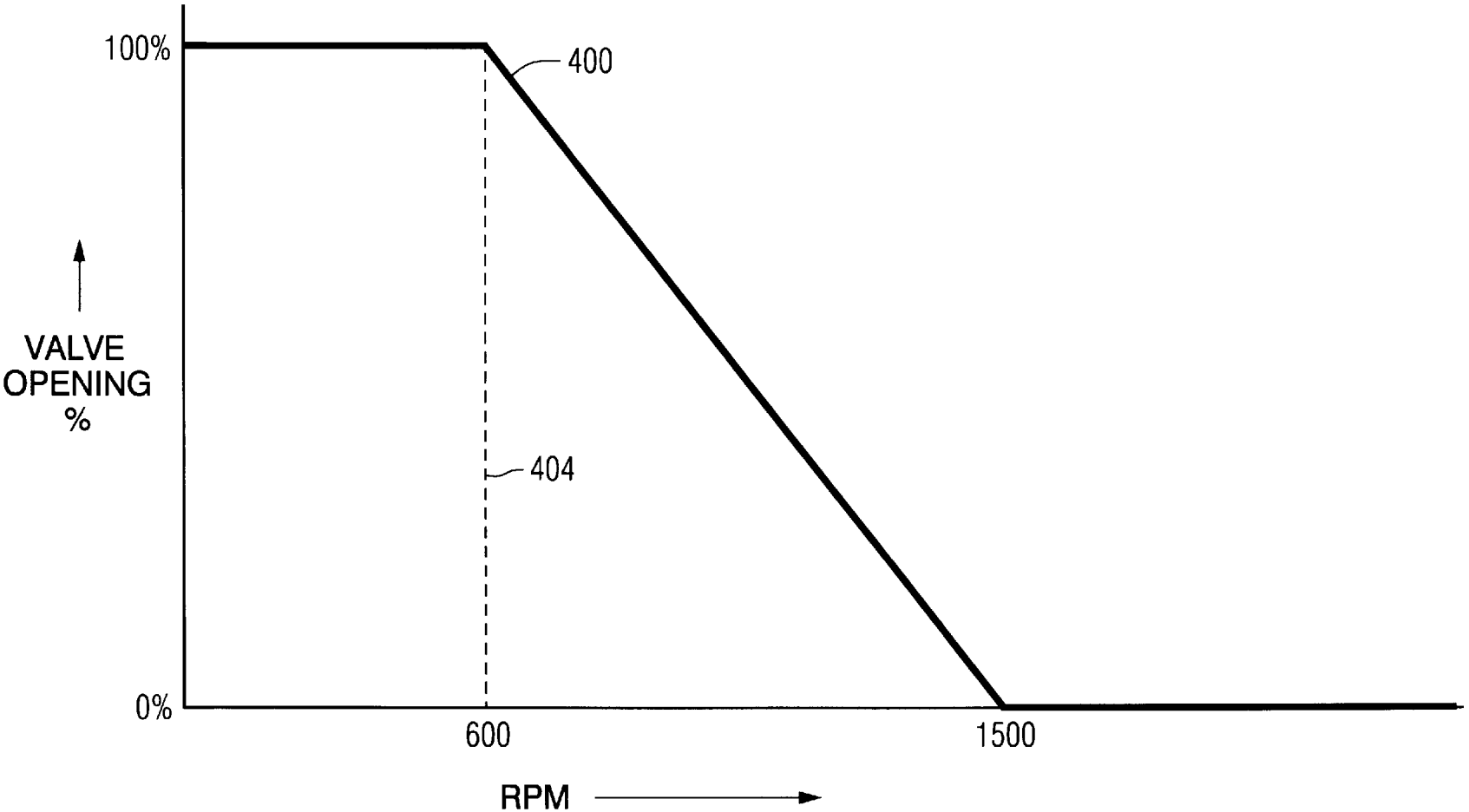
FIG. 4 shows a relationship between the valve opening and engine speed which can be use to control a valve in one embodiment of the present invention.

In FIG. 4, line 400 represents the desired relationship between the valve opening, as a percentage, and the engine speed. As can be seen in FIG. 4, below a preselected engine speed (e.g. 600 RPM) as represented by dashed line 404, the valve remains completely open to bypass all of the fluid from the pump 10 through line 104 to the reservoir 30 shown in FIG. 1. This results in virtually no torque applied to the propeller shaft 24 by the hydrostatic motor 20. Above an upper limit (e.g. 1500 RPM), the valve is completely closed and all fluid from the hydrostatic pump 10 is directed by valve 90 through line 106 to the hydrostatic motor 20. Between the upper and lower RPM limits shown in FIG. 4, the valve opening is determined as a function of RPM. When operating under this mode, the engine control unit 70 monitors the engine speed and selects an appropriate valve opening percentage as a function of engine speed. After performing this function, as represented by functional block 220 in FIG. 2, the engine control unit 70 sets the valve position $V_{POS}$ equal to the valve position $V_{RPM}$ which is determined as a sole function of engine speed, as represented in functional block 230.

With continued reference to the flow chart of FIG. 2, the engine control unit 70 then determines whether or not the operator of the marine vessel has requested any change in throttle position. This is accomplished by the interrogation of functional block 240. It should be understood that the change in throttle position, as provided by a signal from the throttle position sensor 60 in FIG. 1, detected by functional block 240 is significantly less than the change in throttle position detected by the interrogation of functional block 204. The much larger throttle position change $V_{TPS}$ detected by functional block 204 represents the change from an idle speed to wide open throttle WOT or a magnitude which is a significant percentage of that full travel. However, the change detected by functional block 240 is much smaller. If a change is detected at functional block 240, the engine control unit 70, as described by functional block 244, determines whether the engine speed is above a fill power value. If it is, the valve position $V\Delta_{TPS}$ is set to zero at block 246. In other words, the engine control unit 70 will allow the RPM to change solely as a function of throttle position change and will not attempt to interfere with this natural change since the propulsion system is already operating at or above the engine's full power value. If a small change is detected in throttle position as interrogated at functional block 240, but the engine speed is lower than its full power value, the valve position $V_{POS}$ is set equal to the sum of the valve position determined by functional block 220 and the valve position determined, by an appropriate transfer function, as a function of the magnitude of change in throttle position at block 240. These two calculated settings are summed in functional block 250.

After the valve position $V_{POS}$ is determined at functional block 250, the engine control unit 70 determines whether or not an over temperature condition may exist in the oil reservoir 30. This interrogation is represented by functional block 270. It should be noted that functional block 270 is performed either after functional block 216 or after functional block 250. If an over temperature exists, the valve position $V_{POS}$ is set to zero at functional block 272 and the duty cycle which controls the valve 90 is determined accordingly at functional block 278. If the oil temperature is not over a preselected threshold, the duty cycle for the valve 90 is set by functional block 278 in accordance with the valve position $V_{POS}$ determined at functional block 250. The control steps are then repeated.

It should be understood that the recycling of oil through lines 14, 104, and 40 in FIG. 1 can raise the temperature of the oil in the reservoir 30 as a result of the work performed on the oil by the hydrostatic pump 10. For these reasons, it is preferred that most of the oil pressurized by the pump 10 passes through valve 90 and line 106 to drive the hydrostatic motor 20. However, for the reasons described above, this is not advantageous under all circumstances.

Figure 5:
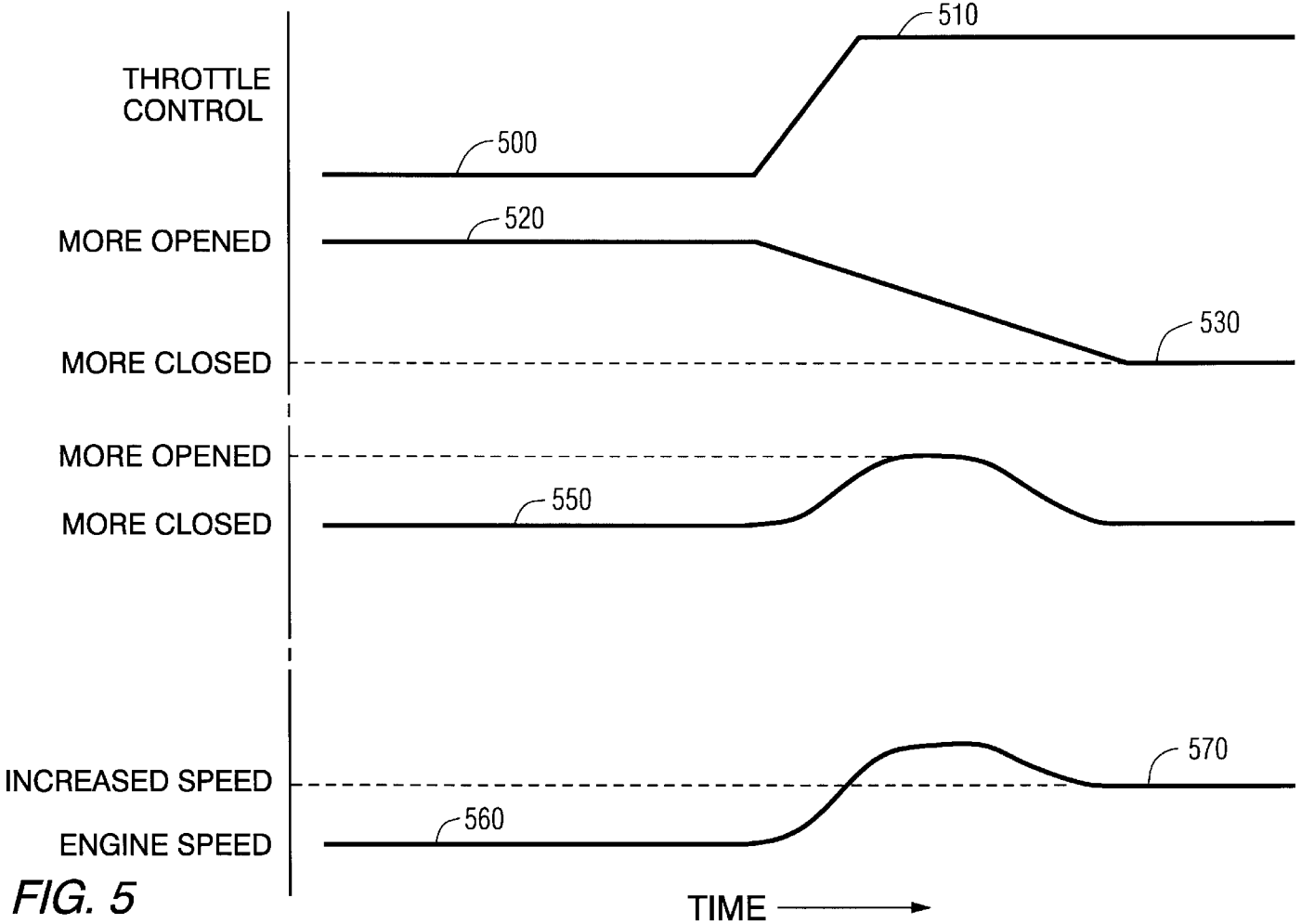
FIG. 5 shows various relationships of throttle and valve positions used to explain certain characteristics of the present invention.

FIG. 5 represents the graphical depictions of some of the steps described above. The graphical representations in FIG. 5 are intended to hypothetically illustrate certain changes in parameters as the engine control unit 70 exercises the steps representing by functional blocks 204, 220, 230, 240, 244, and 250 in FIG. 2. In FIG. 5, line 500 represents a throttle control position during an initial period of time. The throttle control position is then suddenly changed to that represented by line 510 by the operator. This could represent a slight increase in the throttle position that would be typical if a marine vessel operator desired a slight increase in boat speed. The change from line 500 to line 510 is not significantly large to trigger a positive answer by the interrogation of functional block 204 in FIG. 2. As the RPM of the of the engine increases, the engine control unit 70 would select valve opening settings based on the relationship represented by line 400 in FIG. 4. This would cause the valve position to move from one position represented by line 520 to a more closed position represented by line 530. This change would be accomplished by functional blocks 220 and 230 in FIG. 2. This calculated valve position is identified as $V_{RPM}$ in the discussion above. The logic performed by functional blocks 240, 244, and 250 in FIG. 2 would result in a momentary opening of the valve 90 in order to temporarily increase the engine speed to facilitate the change in boat speed requested by the operator. This momentary change in valve position represented by line 550 would be added, at functional block 250 in FIG. 2, to the relationship represented by lines 520 and 530. The result is a relationship represented by line 560 in FIG. 5. As a result of this combined effect, the engine speed changes from the one represented by line 560 to that represented by line 570.

The most significant advantage of a hydrostatic propulsion system is that the engine and the propeller shaft need not be directly and mechanically tied to each other. In a conventional system, such as those represented in FIGS. 6 and 7, the engine 12 has an output shaft 600, such as its crankshaft, which is disposed on a common centerline with a propeller shaft 610 of the marine vessel 620. In a configuration such as that represented in FIG. 6, the engine 12 must be placed in line with the propeller shaft 610. This significantly limits the flexibility of the boat designer regarding the location of the engine 12.

Figure 7:
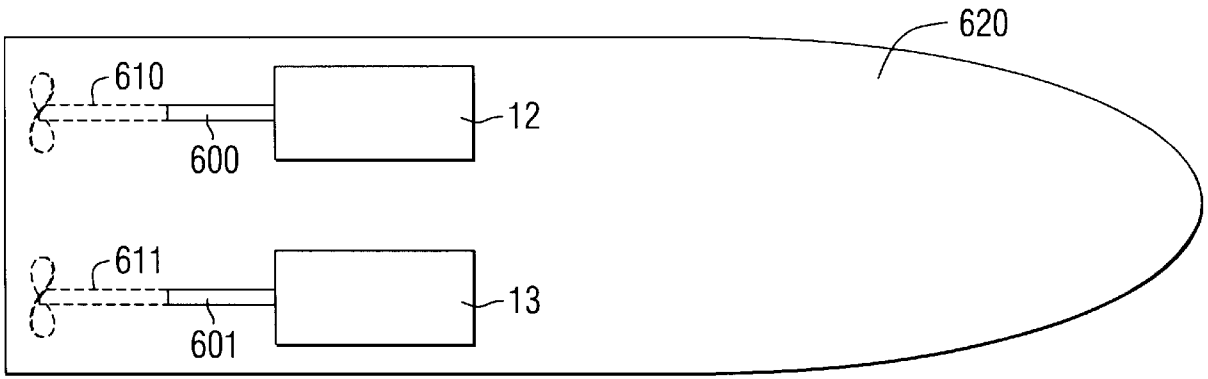
FIG. 7 PRIOR ART

FIG. 7 shows a slightly different arrangement which is generally known to those skilled in the art. Two engines, 12 and 13, each are connected with their output shafts, 600 and 601, aligned on common axes of rotation with propeller shafts, 610 and 611, respectively. As discussed above, the requirement that the output shafts be aligned with the propeller shafts severely limits the flexibility of location of the engines, 12 and 13.

Figure 8:
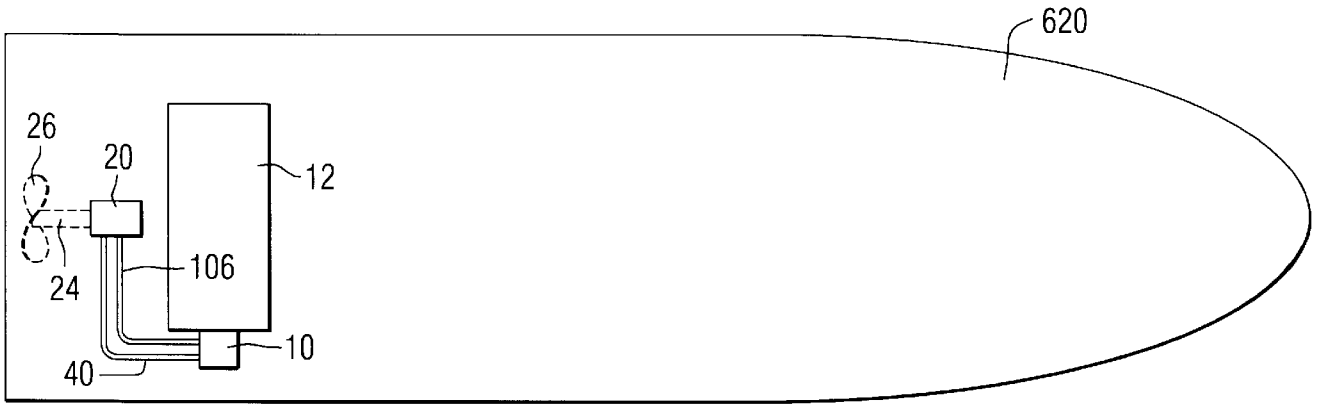
FIGS. 8 and 9 show two arrangements of a single engine with a single hydrostatic motor and propeller.

FIG. 8 shows one possible installation in accordance with the present invention. The engine 12 drives a hydrostatic pump 10 which is connected in fluid communication with a hydrostatic motor 20. In FIG. 8, it should be understood that a valve 90, as described above in conjunction with FIG. 1, would be incorporated either within the housing of the hydrostatic pump 10 or within the housing of the hydrostatic motor 20. Therefore, it is not shown in FIG. 8. For the purposes of this discussion, it will be assumed that both the valve 90 and reservoir 30 described above in conjunction with FIG. 1 are enclosed within the housing of the hydrostatic pump 10. Therefore, they will not appear in the Figures relating to the following description.

Figure 6:
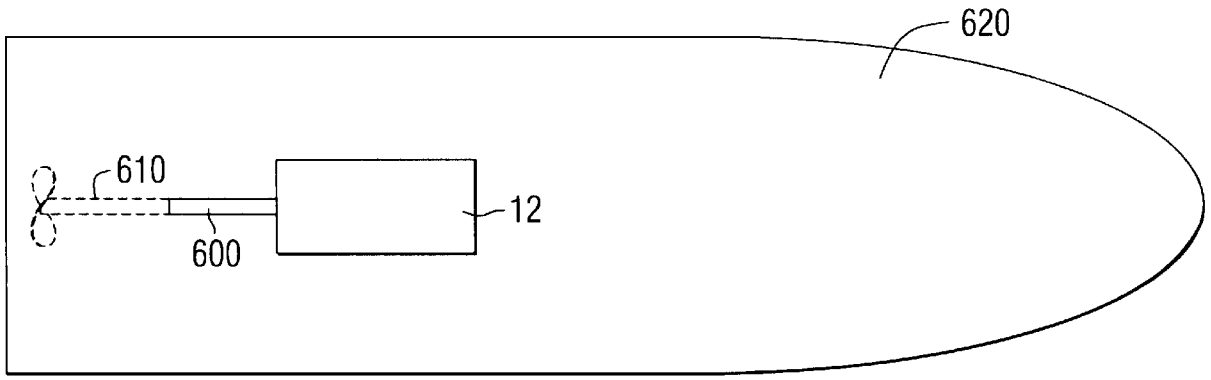
FIG. 6 PRIOR ART
FIGS. 6 and 7 show two known marine vessel arrangements.

With continued reference to FIG. 8, it can be seen that the engine 12 can be aligned perpendicularly to its required position in FIG. 6. In fact, it should further be understood that the engine 12 can be positioned anywhere within the structure of the vessel 620 that is deemed desirable by the boat designer. Lines 106 and 40 in FIG. 8 are typically flexible hoses which have sufficient strength to transmit the pressurized fluid from the hydrostatic pump 10 to the hydrostatic motor 20.

Figure 9:
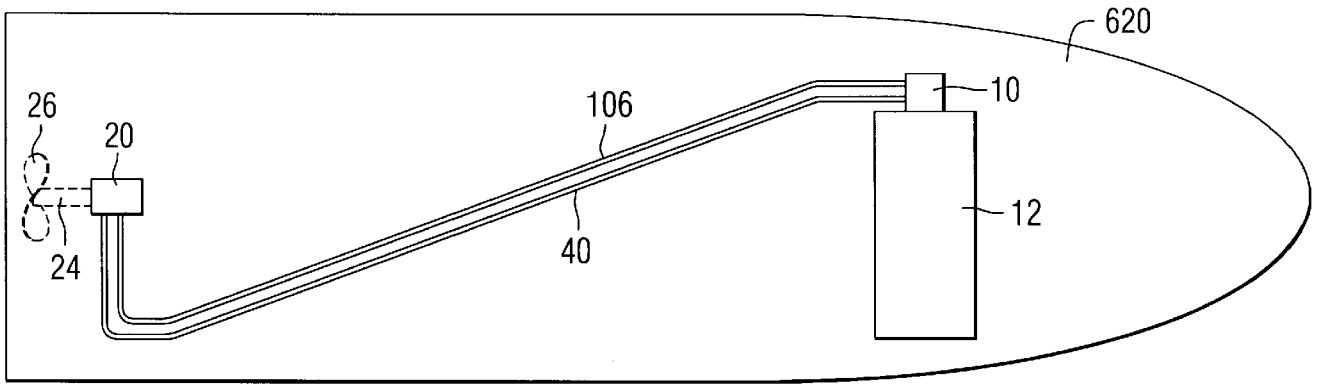

FIG. 9 shows a slightly modified arrangement of the components discussed above in conjunction with FIG. 8. The engine 12 is moved forward in the vessel 620. As can be seen, the engine 12 can be moved to virtually any location within the structure of the vessel 620 because the hydrostatic pump 10 is connected to the hydrostatic motor 20 by flexible tubing or hoses, 40 and 106. By comparing FIGS. 8 and 9, it can be seen that the engine 12 is not only moved forward in FIG. 9, but also rotated by 180 degrees from its position in FIG. 8.

Figure 10:
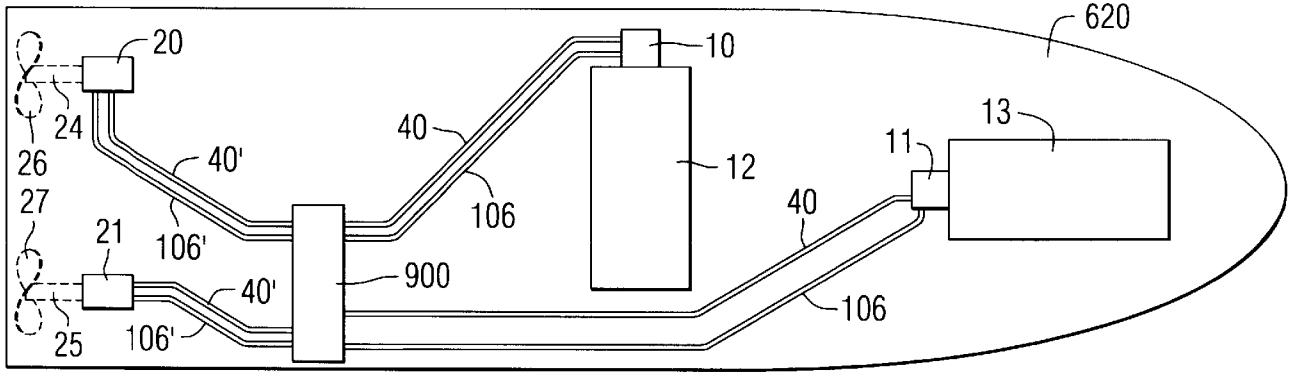
FIG. 10 shows an arrangement with two engines, two hydrostatic pumps, two hydrostatic motors, and a pressurized fluid distributor.

FIG. 10 shows an alternative embodiment of the present invention in which two engines, 12 and 13, drive two hydrostatic pumps, 10 and 11, respectively. The two hydrostatic motors, 20 and 21, receive pressurized fluid through a distributor 900. The function of the distributor 900 is to determine the share of fluid each of the hydrostatic motors, 20 and 21, receives. This is particularly useful when the motors, 20 and 21 are also used for steering purposes. In other words, if more pressurized fluid is provided to hydrostatic motor 21 than to hydrostatic motor 20, that imbalance in torque provided by the two hydrostatic motors will cause the vessel 620 to turn. With continued reference to FIG. 10, it can also be seen that the two engines, 12 and 13, need not be aligned relative to each other in any particular configuration. For example, engine 13 is aligned with the centerline of the vessel 620 while engine 12 is aligned perpendicularly to the centerline of the vessel. In FIG. 10, the pressure lines, 40 and 106, are identified by reference numeral functionally. In other words, the pressurized fluid is provided through line 106 and return fluid flows through line 40. Reference numerals 40' and 106' represent lines with similar functions, but on the opposite side of the distributor 900.

Figure 11:
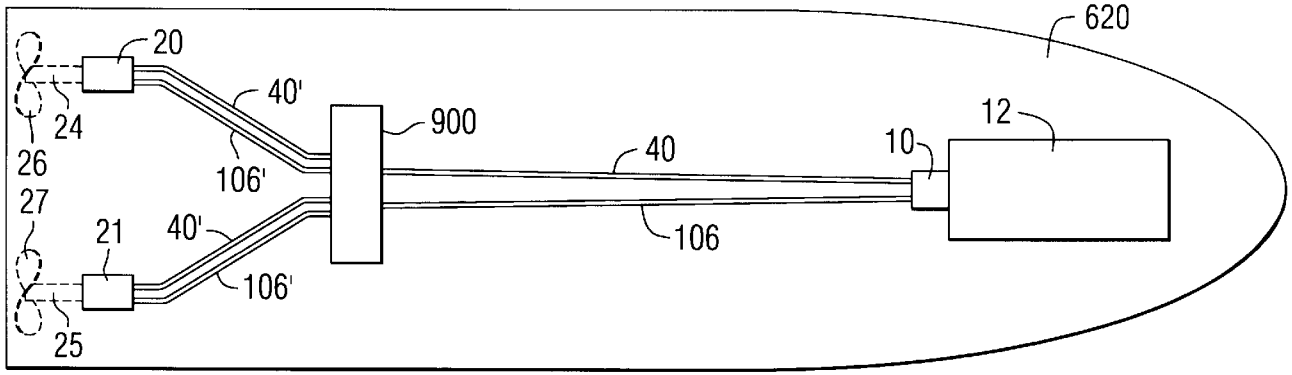
FIG. 11 shows a single engine, two hydrostatic motors, a single hydrostatic pump, and a high pressure fluid distributor.

FIG. 11 shows an embodiment of the present invention with a single engine 12 and a single hydrostatic pump 10, but two hydrostatic motors, 20 and 21, driving two propellers, 26 and 27, respectively. A distributor 900 distributes the pressurized oil and returning oil as desired by the vessel operator. As described above, this distribution of high pressure oil by the distributor 900 to the two hydrostatic motors, 20 and 21, can be beneficial in steering the vessel 620.

With reference to FIG. 1, and the discussion above in relation to the other figures, it can be seen that the valve 90 serves a useful purpose in allowing some of the oil from the hydrostatic pump 10 to bypass the hydrostatic motor 20 and return immediately to the reservoir 30. This bypassing of some high pressure oil through lines 14 and 104 effectively unloads the engine 12 to a preselected degree which is determined by the amount that valve 90 is opened for these bypassing purposes. When the engine 12 is unloaded in this manner, it increases in speed for any particular throttle position and achieves a more advantageous and efficient operating characteristic as described above in conjunction with FIG. 3. By allowing the engine 12 to operate at a more efficient engine speed, improved acceleration can be achieved. If, on the other hand, no valve 90 was provided and all of the fluid pressurized by the hydrostatic pump 10 flowed through the hydrostatic motor 20, a rapid increase in throttle position could not be rapidly responded to by the engine 12. However, by momentarily bypassing some of the oil through valve 90 directly to the reservoir 30, the engine is allowed to operate at a higher RPM because of the reduced load of the motor 20 and can more efficiently achieve the desired speed commanded by the vessel operator. The engine control unit 70 can monitor the throttle position signal provided by the throttle position sensor 60, and the engine speed signal provided on dashed line 52 from a tachometer, or similar device, and a temperature signal provided on dashed line 51 which indicates oil temperature.

As described above, the engine control unit 70 responds to at least three different conditions. One condition consists of a rapid and significant change in throttle position such as that which would occur if the boat operator moves a throttle control handle from idle speed to wide open throttle WOT. Another condition would occur when the operator makes a slight, but discernable, change in the throttle handle position which is less than the severe magnitude of change described above. A third condition is during normal running when the engine control unit 70 continually monitors the engine speed and adjusts the valve 90 to match its percentage opening to a predetermined relationship as discussed above in conjunction with FIG. 4. During normal changes in throttle handle position, it is typical for the valve position to be controlled as a dual function of both engine speed and the moderate change in throttle position as described above in conjunction with FIG. 5.

By allowing a hydrostatic transmission to achieve improved acceleration characteristics, the present invention makes possible the use of hydrostatic transmissions in pleasure craft where moderately rapid acceleration are sometimes desired. The ability to use hydrostatic transmissions in pleasure craft provides the additional benefit of allowing extremely flexible placement of the engine, hydrostatic pump, and hydrostatic motors within the structure of the marine vessel.

Although the present invention has been described with particular detail and illustrated to show many different embodiments, it should be understood that other embodiments are within its scope.

We claim:

1. A marine propulsion system, comprising:

a first hydrostatic pump;

a first engine having an output shaft connected to a drive shaft of said first hydrostatic pump;

a first sensor having an output which is representative of a preselected first parameter of said first engine;

a first hydrostatic motor;

a first propeller attached to a first shaft of said first hydrostatic motor;

a fluid reservoir connected in fluid communication with an inlet of said first hydrostatic pump to supply a fluid to said pump, an outlet of said first hydrostatic motor being connected in fluid communication with said fluid reservoir;

a first valve having an inlet connected in fluid communication with said first hydrostatic pump, said first valve having first and second outlets, said first valve being connected in fluid communication between said first hydrostatic pump and said first hydrostatic motor with said first outlet of said first valve connected to an inlet of said first hydrostatic motor and with said second outlet of said first valve connected in fluid communication with said fluid reservoir; and a controller having an input connected in signal communication with said output of said first sensor, said controller having an output connected in signal communication with an input of said first valve to control the magnitude of said fluid flowing through said first and second outlets of said first valve as a function of said preselected first parameter.

2. The marine propulsion system of claim 1, wherein:

said first parameter is first engine speed.

3. The marine propulsion system of claim 2, wherein:

said first sensor is a tachometer.

4. The marine propulsion system of claim 1, wherein:

said controller regulates said first valve as a function of the speed of operation of said first engine.

5. The marine propulsion system of claim 1, further comprising:

a second sensor having an output which is representative of a preselected second parameter of said engine.

6. The marine propulsion system of claim 5, wherein:

said controller regulates said first valve as a function of said first parameter.

7. The marine propulsion system of claim 6, wherein:

said controller regulates said first valve as a function of said first and second parameters.

8. The marine propulsion system of claim 7, wherein:

said first parameter is engine speed.

9. The marine propulsion system of claim 8, wherein:

said second parameter is throttle position.

10. The marine propulsion system of claim 1, further comprising:

a second hydrostatic motor and a second propeller attached to a second shaft of said second hydrostatic motor; and a fluid distributor connected in fluid communication between said first hydrostatic pump and said first and second hydrostatic motors to distribute pressurized fluid to said first and second hydrostatic motors.

11. The marine propulsion system of claim 1, further comprising:

a second hydrostatic pump; and a second engine having an output shaft connected to a drive shaft of said second hydrostatic pump.

12. The marine propulsion system of claim 11, further comprising:

a distributor connected in fluid communication between said first hydrostatic motor and said first and second hydrostatic pumps.

13. The marine propulsion system of claim 12, further comprising:

a second hydrostatic motor; and a second propeller attached to a second shaft of said second hydrostatic motor, said distributor being connected between said first and second hydrostatic pumps and said first and second hydrostatic motors.

14. The marine propulsion system of claim 1, wherein:

said valve is an infinitely variable valve which can distribute fluid between its first and second outlets according to an infinitely variable proportion.

15. A marine propulsion system, comprising:

a first hydrostatic pump;

a first engine having an output shaft connected to a drive shaft of said first hydrostatic pump;

a first sensor having an output which is representative of a preselected first parameter of said first engine;

a first hydrostatic motor;

a first propeller attached to a first shaft of said first hydrostatic motor;

a fluid reservoir connected in fluid communication with an inlet of said first hydrostatic pump to supply a fluid to said pump, an outlet of said first hydrostatic motor being connected in fluid communication with said fluid reservoir;

a first valve having an inlet connected in fluid communication with said first hydrostatic pump, said first valve having first and second outlets, said first valve being connected in fluid communication between said first hydrostatic pump and is said first hydrostatic motor with said first outlet of said first valve connected to an inlet of said first hydrostatic motor and with said second outlet of said first valve connected in fluid communication with said fluid reservoir; and a controller having an input connected in signal communication with said output of said first sensor, said controller having an output connected in signal communication with an input of said first valve to control the magnitude of said fluid flowing through said first and second outlets of said first valve as a function of said preselected first parameter, wherein said first parameter is a speed of operation of said first engine and said controller regulates said first valve as a function of said speed of operation of said first engine.

16. The marine propulsion system of claim 15, further comprising:

a second sensor having an output which is representative of a preselected second parameter of said engine, said controller regulating said first valve as a function of said first and second parameters.

17. The marine propulsion system of claim 16, wherein:

said second parameter is throttle position.

18. The marine propulsion system of claim 15, further comprising:

a second hydrostatic motor and a second propeller attached to a second shaft of said second hydrostatic motor; and a fluid distributor connected in fluid communication between said first hydrostatic pump and said first and second hydrostatic motors to distribute pressurized fluid to said first and second hydrostatic motors.

19. The marine propulsion system of claim 15, further comprising:

a second hydrostatic pump; and a second engine having an output shaft connected to a drive shaft of said second hydrostatic pump.

20. A marine propulsion system, comprising:

a first hydrostatic pump;

a first engine having an output shaft connected to a drive shaft of said first hydrostatic pump;

a first sensor having an output which is representative of a preselected first parameter of said first engine;

a first hydrostatic motor;

a first propeller attached to a first shaft of said first hydrostatic motor;

a fluid reservoir connected in fluid communication with an inlet of said first hydrostatic pump to supply a fluid to said pump, an outlet of said first hydrostatic motor being connected in fluid communication with said fluid reservoir;

a first valve having an inlet connected in fluid communication with said first hydrostatic pump, said first valve having first and second outlets, said first valve being connected in fluid communication between said first hydrostatic pump and said first hydrostatic motor with said first outlet of said first valve connected to an inlet of said first hydrostatic motor and with said second outlet of said first valve connected in fluid communication with said fluid reservoir;

a controller having an input connected in signal communication with said output of said first sensor, said controller having an output connected in signal communication with an input of said first valve to control the magnitude of said fluid flowing through said first and second outlets of said first valve as a function of said preselected first parameter;

a second hydrostatic motor and a second propeller attached to a second shaft of said second hydrostatic motor;

a fluid distributor connected in fluid communication between said first hydrostatic pump and said first and second hydrostatic motors to distribute pressurized fluid to said first and second hydrostatic motors;

a second hydrostatic pump;

a second engine having an output shaft connected to a drive shaft of said second hydrostatic pump; and a second propeller attached to a second shaft of said second hydrostatic motor, said fluid distributor being connected between said first and second hydrostatic pumps and said first and second hydrostatic motors.

* * * * *